US008578557B2

(12) United States Patent
Yu

(10) Patent No.: US 8,578,557 B2
(45) Date of Patent: Nov. 12, 2013

(54) PATCH FITTING WITH CLOSING FUNCTION

(75) Inventor: King-Sung Yu, ChangHua County (TW)

(73) Assignee: Leado Door Controls Ltd., YuanLin Township, ChangHua County (TW), .

( * ) Notice: Subject to any disclaimer, the term of this patent is extended or adjusted under 35 U.S.C. 154(b) by 16 days.

(21) Appl. No.: 13/479,830

(22) Filed: May 24, 2012

(65) Prior Publication Data

US 2013/0185896 A1 Jul. 25, 2013

(30) Foreign Application Priority Data

Jan. 19, 2012 (TW) ..... 101102277 A

(51) Int. Cl.
*E05F 3/22* (2006.01)

(52) U.S. Cl.
USPC ..... 16/55; 16/60; 16/274; 16/312

(58) Field of Classification Search
USPC ..... 16/55, 56, 59, 60, 274, 277, 309, 312, 16/378, DIG. 21
See application file for complete search history.

(56) References Cited

U.S. PATENT DOCUMENTS

| | | | | |
|---|---|---|---|---|
| 4,019,220 | A * | 4/1977 | Lieberman | 16/59 |
| 5,613,276 | A * | 3/1997 | Franz | 16/229 |
| 6,643,898 | B1 * | 11/2003 | Cameron et al. | 16/382 |
| 6,925,685 | B2 * | 8/2005 | Chen | 16/332 |
| 6,966,150 | B2 * | 11/2005 | Chiang | 49/388 |
| 7,007,341 | B2 * | 3/2006 | Wang | 16/60 |
| 8,443,487 | B2 * | 5/2013 | Bacchetti | 16/51 |
| 2005/0050685 | A1 * | 3/2005 | Chen | 16/332 |
| 2005/0144757 | A1 * | 7/2005 | Chiang | 16/252 |
| 2008/0034535 | A1 * | 2/2008 | Chiang | 16/60 |
| 2008/0168621 | A1 * | 7/2008 | Lin | 16/252 |
| 2010/0319265 | A1 * | 12/2010 | Theisen | 49/388 |

* cited by examiner

*Primary Examiner* — Robert A Delisle
(74) *Attorney, Agent, or Firm* — Muncy, Geissler, Olds & Lowe, PLLC

(57) ABSTRACT

A patch fitting for a glass door includes a mount for being mounted on a floor, a shaft connected with the mount, a clamping seat pivotally connected with the shaft, and a piston unit installed inside the clamping seat. When the glass door is sweeping to open or close, the clamping seat will turn along with the sweeping movement of the glass door about the shaft and the piston unit will be pushed by an eccentric cam of the shaft to press the hydraulic oil contained in the clamping seat so as to provide a damping resistance in response to the sweeping movement of the glass door. The patch fitting can be easily installed on the floor by a simple work.

9 Claims, 7 Drawing Sheets

PATCH FITTING WITH CLOSING FUNCTION

BACKGROUND OF THE INVENTION

1. Field of the Invention

The present invention relates generally to a patch fitting with a closing function for mounting and closing a glass door and more particularly, to such a patch fitting that can be conveniently installed by a simple work.

2. Description of the Related Art

Conventionally, a glass door is supported by hinges for enabling the glass door to be pivotally opened or closed. Because the glass door has a certain weight, the pivots of the hinges may become unstable after the hinges are used for a long time, resulting in that the glass door may offset downwardly. If this phenomenon happens, when the glass door is opened or closed, the glass door may hit the floor easily to cause damage and in a worse situation, the glass door may be broken accidently. To resolve the aforesaid problem, a door closer concealedly mounted in the floor, i.e. the so-called "concealed floor door closer" or "floor hinge", is nowadays used for holding the glass door.

The concealed floor door closer has the advantages of high reliability and high weight-bearing ability and is capable of adjusting the open angle and the return speed. However, before the concealed floor door closer is installed, the floor needs to be cut with a recessed mounting hole subject to the size of the concealed floor door closer to be mounted. After the door closer is embedded in the mounting hole, it usually needs to wait for another one or two days for mounting the glass door. The whole installation process of the conventional concealed floor door closer is quite complicated.

SUMMARY OF THE INVENTION

The present invention has been accomplished in view of the above-noted circumstances. It is an objective of the present invention to provide a patch fitting for a glass door, which can be easily installed on the floor and can provide a damping resistance against the opening force and closing force during the process of opening and closing the glass door.

To attain the above-mentioned objective, the patch fitting for a glass door provided by the present invention comprises a mount, a shaft, a clamping seat and a piston unit. The mount is adapted for being mounted on a floor. The shaft has a shaft body with an end connected with the mount, and an eccentric cam provided on the shaft body. The clamping seat is adapted for clamping the glass door. The clamping seat has an oil chamber and a shaft hole in fluid communication with the oil chamber. The shaft is inserted into the shaft hole of the clamping seat such that the clamping seat is turnable about the shaft along with a sweeping movement of the glass door. The piston unit is installed in the oil chamber of the clamping seat and contacted with the eccentric cam of the shaft, such that when the clamping seat is turned, the piston unit is actuated by the eccentric cam of the shaft to the press hydraulic oil contained in the oil chamber so as to provide a damping resistance in response to the sweeping movement of the glass door. The patch fitting can be easily mounted on the floor by a simple work and can provide a damping resistance of oil pressure to damp the opening force and the closing force exerting on the glass door.

In a preferred embodiment of the present invention, the mount of the patch fitting comprises a mounting plate, a plurality of adjustment members and an adjustment plate. The mounting plate has a receiving space and a periphery provided with a plurality of adjustment holes communicated with the receiving space. Each of the adjustment members is screwingly inserted in one of the adjustment holes of the mounting plate. The adjustment plate is arranged in the receiving space of the mounting plate, connected with the end of the shaft and stopped by the adjustment members such that the adjustment plate can be actuated by the adjustment members to move backward and forward or leftward and rightward or to rotate relative to the mounting plate so as to compensate the offset of the glass door for enabling the glass door to be closed positively.

BRIEF DESCRIPTION OF THE DRAWING

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
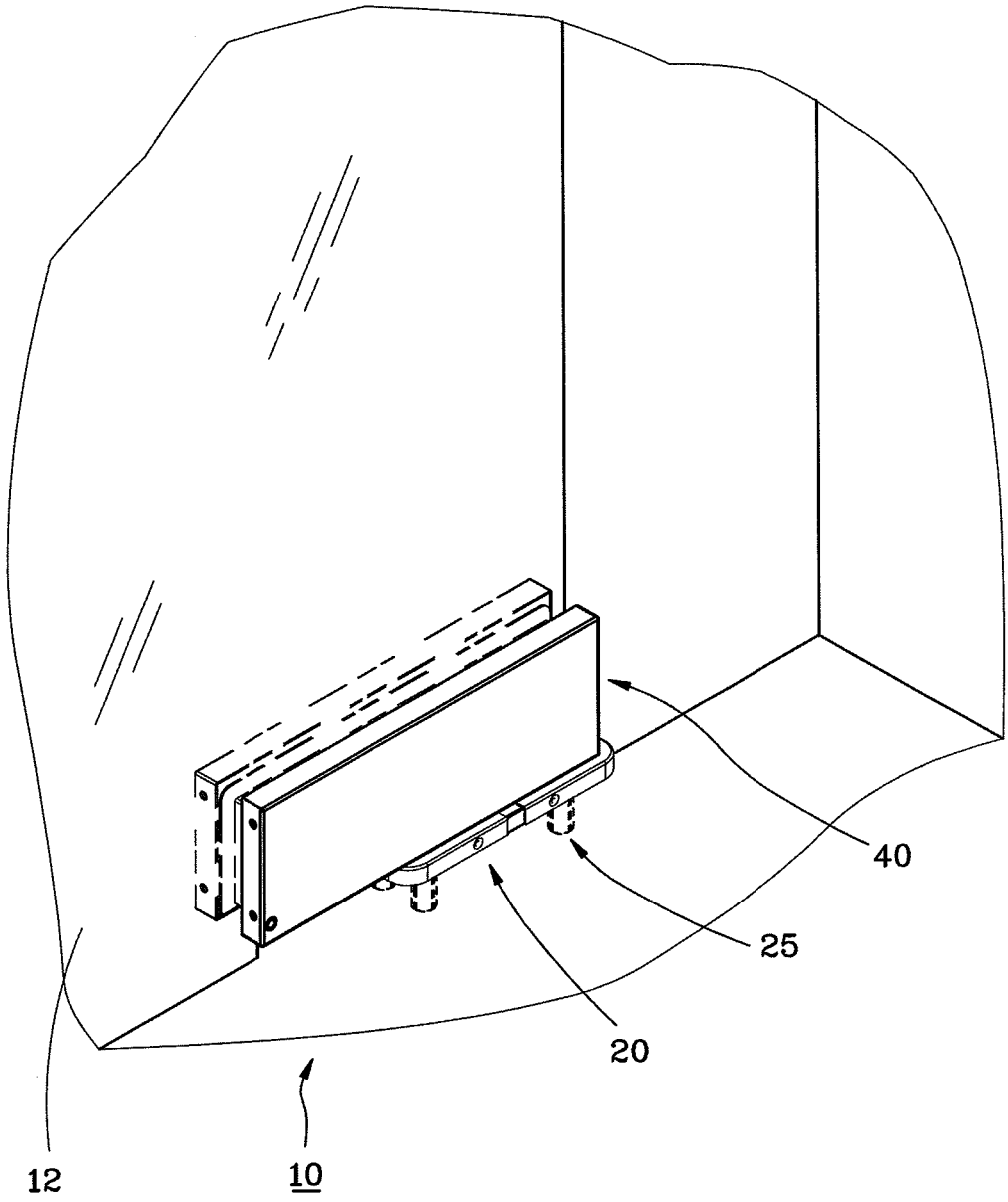
FIG. 1 is a schematic perspective view showing a patch fitting in accordance with a preferred embodiment of the present invention is installed on a floor and coupled with a glass door.

As shown in FIGS. 1-4, the patch fitting 10 provided according to a preferred embodiment of the present invention comprises a mount 20, a shaft 30, a clamping seat 40, and a piston unit 50.

The mount 20 includes a mounting plate 21, a plurality of adjustment member 22*a*, 22*b*, an adjustment plate 23, and two end plates 24. The mounting plate 21 is provided with a receiving space 212 at its center and two mounting holes 214 located respectively at left and right sides relative to the receiving space 212, through each of which an expansion bolt 25 is inserted such that the mounting plate 21 is fixedly mounted on the floor by the expansion blots 25, as shown in FIG. 1. In addition, the periphery of the mounting plate 21 is provided with a plurality of threaded adjustment holes 216 communicated with the receiving space 212 for installation of the adjustment members 22*a*, 22*b*. The adjustment plate 23 is arranged in the receiving space 212 of the mounting plate 21 and stopped and pushable by the adjustment members 22*a* and 22*b*, such that the adjustment plate 23 is drivenable by the adjustment members 22*a* or 22*b* to move backward and forward or leftward and rightward or to rotate relative to the mounting plate 21, i.e. the position of the adjustment plate 23 is adjustable relative to the mounting plate 21 by actuations of the adjustment members 22*a* and 22*b*. Further, the adjustment plate 23 is provided at the center thereof with an insertion hole 232. The two end plates 24 are coupled with two ends of the mounting plate 21 respectively. In practice, the end plates 24 can be eliminated according to actual need.

Figure 3:
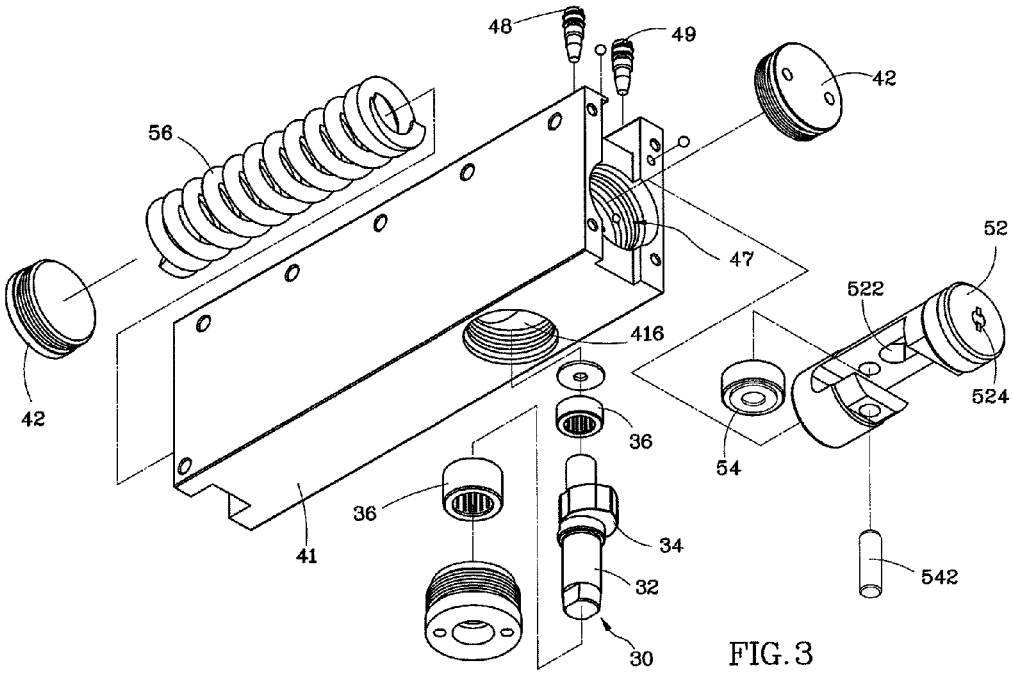

As shown in FIG. 3, the shaft 30 has a shaft body 32 on which an eccentric cam 34 is provided. The bottom end of the shaft 30 is inserted into the insertion hole 232 of the adjustment plate 23 of the mount 20. In addition, a bearing 36 is sleeved on each of the top and bottom sections of the shaft body 32 of the shaft 30.

Figure 2:
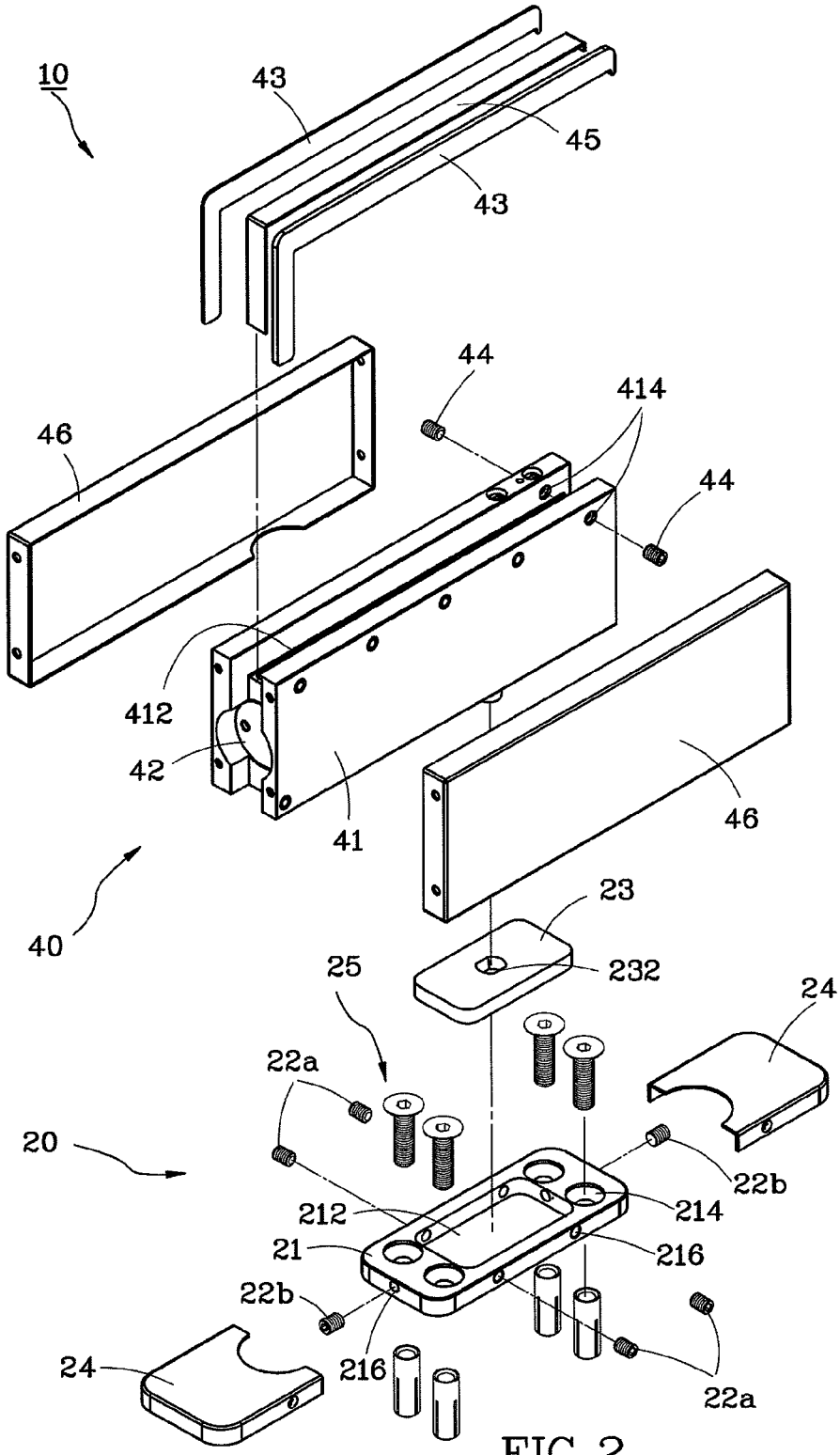
FIGS. 2 and 3 are partially exploded views of the patch fitting in accordance with the preferred embodiment of the present invention.
Figure 4:
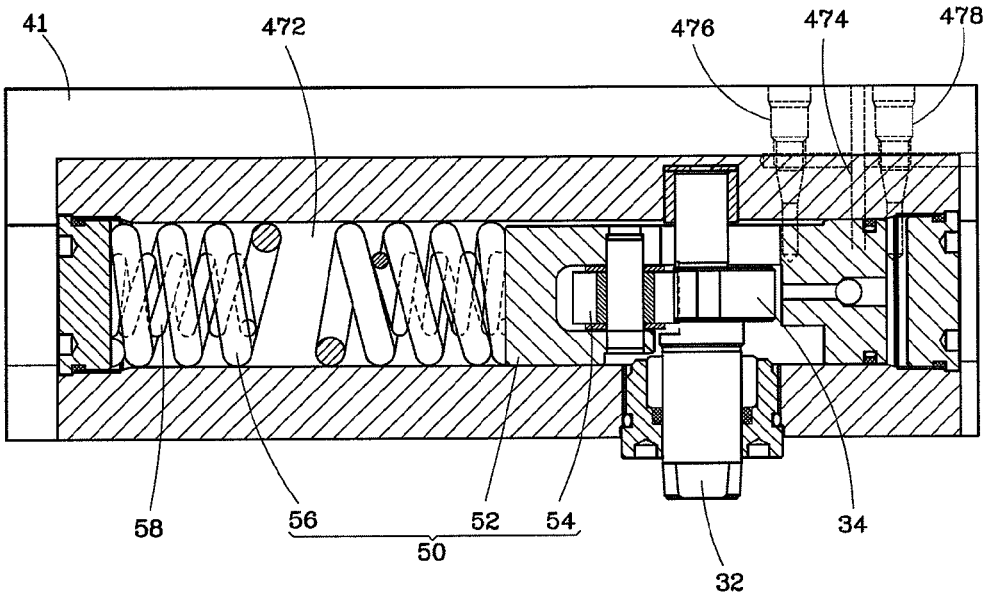
FIG. 4 is a cross-sectional view of the clamping seat and the piston unit of the patch fitting of the preferred embodiment of the present invention.
Figure 5A:
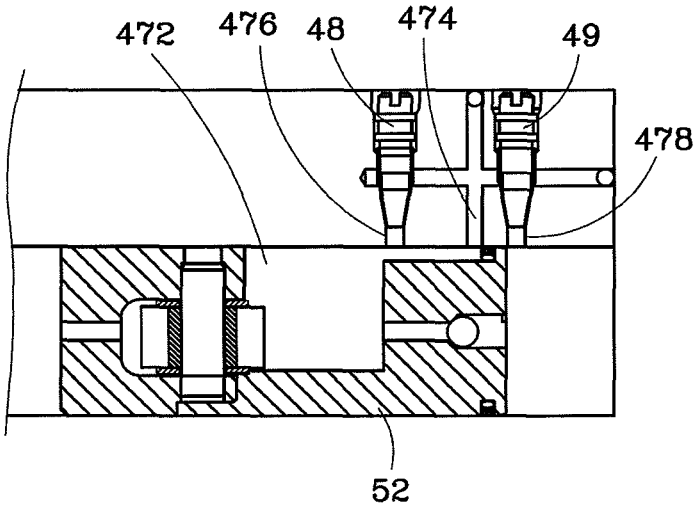
FIG. 5A to FIG. 5D are cross-sectional views showing the processes of how the piston unit presses the hydraulic oil.

As shown in FIGS. 2-4, the clamping seat 40 includes a seat body 41, two end caps 42, two clamping pieces 43, and a plurality of fasteners 44. The seat body 41 has an insertion groove 412 for insertion of a glass door 12. A decorative strip 45 may be inserted in the insertion groove 412 according to the user's need. In addition, the two side walls that define the insertion groove 412 are provided with a plurality of threaded through holes 414 communicated with the insertion groove 412. A decorative plate 46 may be provided and mounted on each side wall of the seat body 41 according to the user's need. Further, as shown in FIGS. 3 and 4, the seat body 41 is provided at its inside with an oil chamber 47, which can be divided into a compartment 472, an oil duct 474 in fluid communication with the compartment 472, and two valve holes 476 and 478 spaced from each other and in fluid communication with the compartment 472 and the oil duct 474. Two regulation valves 48 and 49 are respectively mounted in the valve holes 476 and 478 as shown in FIG. 5A. The bottom of the seat body 41 is opened with a shaft hole 416 in communication with the compartment 472 of the oil chamber 47. The shaft 30 is inserted into the shaft hole 416 such that the seat body 41 of the clamping seat 40 is turnable along with a sweeping movement of the glass door 12 about the shaft 30 by means of the two bearings 36. The two end caps 42 are mounted on the two ends of the seat body 41 to seal two end openings of the compartment 472 of the oil chamber 47. The clamping pieces 43 are arranged in the insertion groove 412 of the seat body 41 and abutted against two opposite surfaces of the glass door 12 respectively. The fasteners 44, which are screws in this embodiment, are respectively screwingly inserted in the through holes 414 of the seat body 41 and urged against the clamping pieces 43 such that the clamping pieces 43 can be pushed by these fasteners 44 to firmly clamp the glass door 12 therebetween.

The piston unit 50 is installed in the compartment 472 of the oil chamber 47 and will function at the time when the clamping seat 40 is turned. The piston unit 50 includes a piston 52, a contact member 54 and two springs 56 and 58. The piston 52 has an elongated through hole 522 through which the shaft body 32 of the shaft 30 passes, and two oil passages 524 at two end portions thereof for conducting hydraulic oil. The contact member 54, which is a roller in this embodiment, is rotatably mounted to the piston 52 by a pivot pin 542 and in contact with the eccentric cam 34 of the shaft 30, such that the contact member 54 will be pushed by the eccentric cam 34 to move at the time when the clamping seat 40 is turned. The spring 56 has two ends stopped at the piston 52 and one of the end caps 42 for providing a rebound force to return the piston 52. The spring 58 is inserted into inside of the spring 56 and has two ends stopped at the piston 52 and the one of the end caps 42 for providing a rebound force and a resilient compensation effect. It'll be appreciated that one of the springs 56 and 58 can be eliminated according to actual need.

The structure of the patch fitting 10 has been detailedly described as above and the feature and operation of the patch fitting 10 will be further recited hereunder.

Figure 5B:
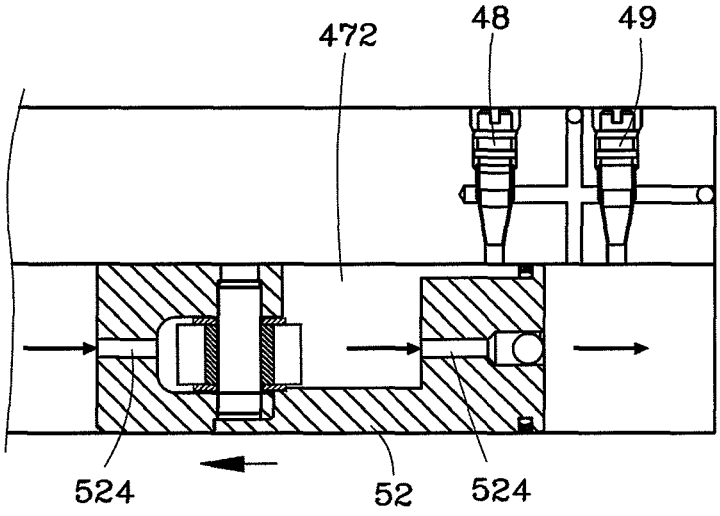

When the glass door 12 is pushed to open, the clamping seat 40 will turn along with the sweeping movement of the glass door 12 about the shaft body 32 of the shaft 30, which is served as a pivot center. At this moment, the piston 52 is pushed by the eccentric cam 34 of the shaft 30 to move in the compartment 472 of the oil chamber 47 in a direction away from the regulation valves 48 and 49, resulting in that the hydraulic oil that is pressed by the piston 52 will flow from a left side of the piston 52 through the oil passages 524 to a right side of piston 52 as shown in FIGS. 5A and 5B.

Figure 5C:
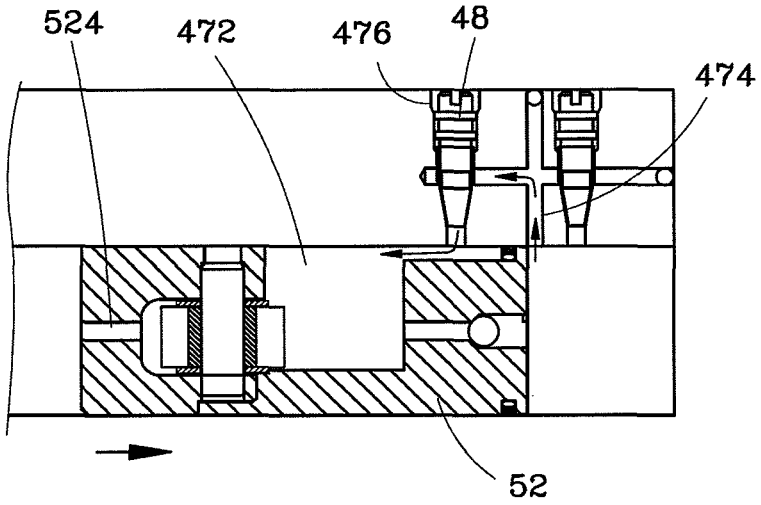
Figure 5D:
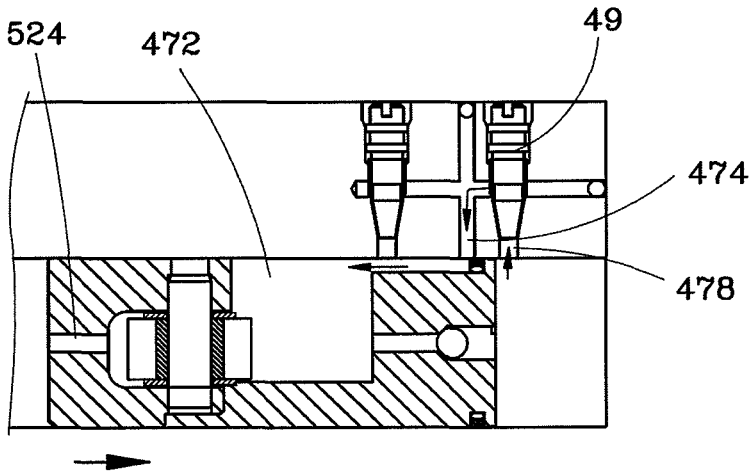

When the glass door 12 is closed, in an initial stage the piston 52 will be pushed by the spring 56 to move in a reverse direction to force the hydraulic oil to flow through the oil duct 474, the regulation valve 48 and the valve hole 476 into the compartment 472 and then flow toward the left side of the piston 52 through one of the oil passages 524 as shown in FIG. 5C. When the glass door 12 is continuously closed to an extent that the hydraulic oil is blocked by the piston 52 from entering from the entrance of the oil duct 474 into the oil duct 474, the hydraulic oil will be forced to flow through the valve hole 478, the regulation valve 49 and the oil duct 474 into the compartment 472 and then flow toward the left side of the piston 52 through one of the oil passages 524, as shown in FIG. 5D, until the glass door 12 is completely closed. The sweeping speed of the glass door at different door closing stages can be adjusted by adjustment of the flow rate of the hydraulic oil through the regulation valve 48 and/or the regulation valve 49.

Figure 6A:
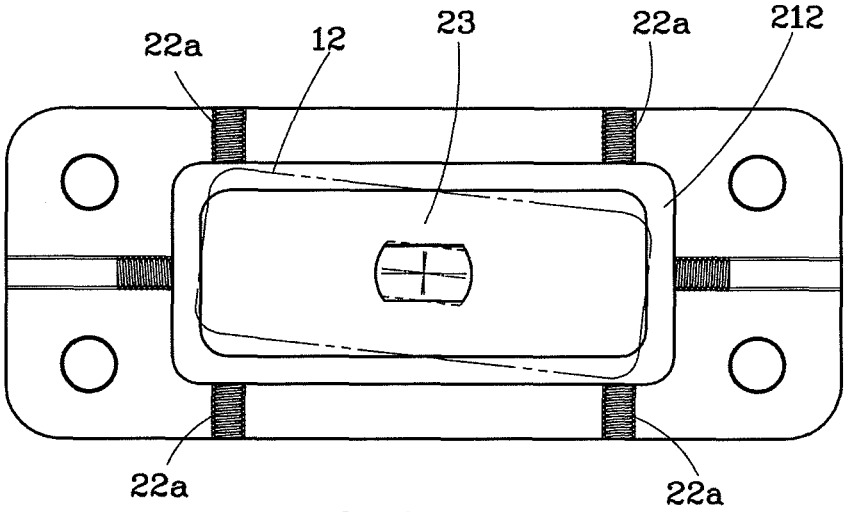
FIG. 6A to FIG. 6C are bottom views of the mount of the patch fitting of the preferred embodiment of the present invention, showing the ways of how to compensate the offset of the glass door.
Figure 6B:
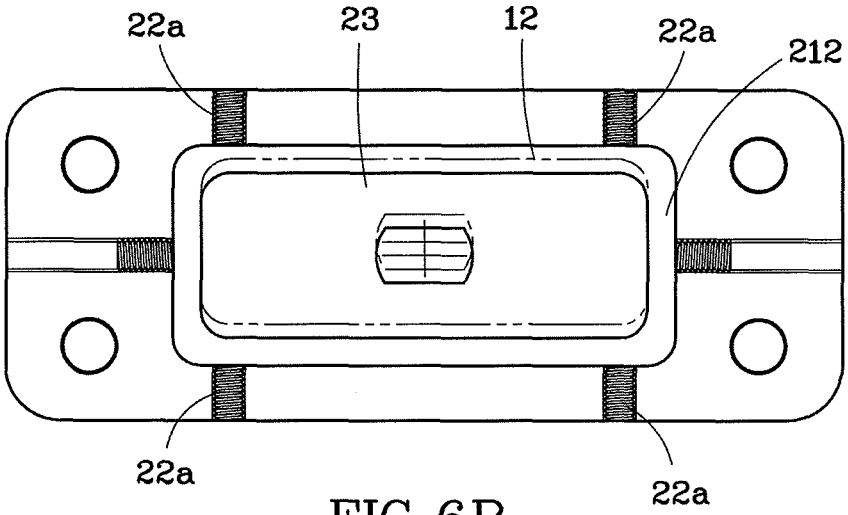
Figure 6C:
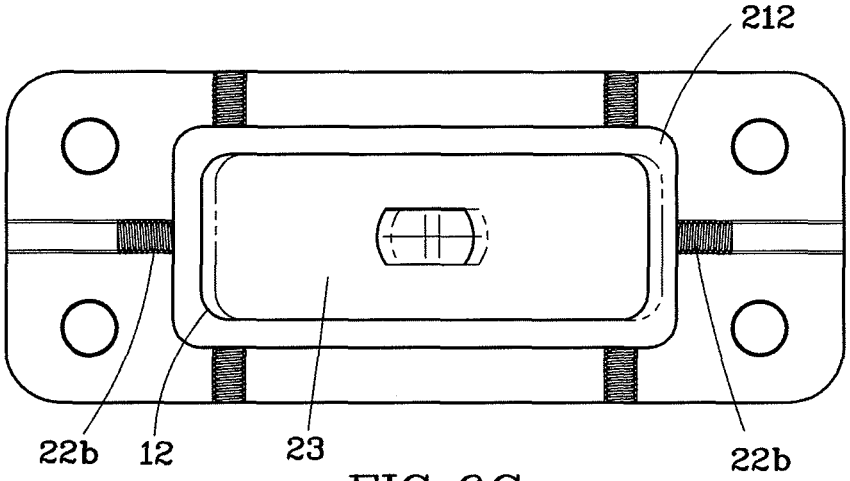

On the other hand, if a displacement offset happens to cause misalignment of the door glass when the glass door is stayed in the closed position, the rotational offset or the offset in the backward and forward direction can be compensated by rotating the adjustment plate 23 or moving the adjustment plate 23 in the backward and forward direction in the receiving space 212, which can be done by pushing the two lateral sides of the adjustment plate 23 by the four adjustment members 22*a*, as shown in FIG. 6A and FIG. 6B. That is, by means of adjusting the position of the adjustment plate 23 relative to the mounting plate 21 and by means of the coupling relationships among the shaft 30, the piston unit 50 and the clamping seat 40, the rotational offset or the displacement offset in the backward and forward direction can be compensated. As to the displacement offset in the leftward and rightward direction, it can be compensated by the adjustment members 22*b* that are urged against the two ends of the adjustment plate 23, as shown in FIG. 6C.

As indicated above, the patch fitting 10 can be fixedly installed on the floor by a few of the expansion bolts 25. The floor doesn't need to be cut with a mounting hole for installation of the patch fitting 10, thereby simplifying the work of installation. In addition, the patch fitting 10 can provide a hydraulic oil damping resistance generated between the piston unit 50 and the hydraulic oil to damp the force for opening or closing the glass door. Further, after the patch fitting 10 is installed, the position of the glass door can be lightly adjusted to make sure that the glass door can be closed positively.

What is claimed is:

1. A patch fitting for a glass door, comprising:

a mount for being mounted on a floor;

a shaft having a shaft body with an end connected with the mount, and an eccentric cam provided on the shaft body;

a clamping seat for clamping the glass door, which has an oil chamber and a shaft hole in fluid communication with the oil chamber; wherein the shaft is inserted into the shaft hole of the clamping seat such that the clamping seat is turnable about the shaft along with a sweeping movement of the glass door; and a piston unit installed in the oil chamber of the clamping seat and contacted with the eccentric cam of the shaft, such that when the clamping seat is turned, the piston unit is actuated by the eccentric cam of the shaft to press a hydraulic oil contained in the oil chamber so as to provide a damping resistance in response to the sweeping movement of the glass door.

2. The patch fitting of claim 1, wherein the mount comprises a mounting plate having a receiving space and a periphery provided with a plurality of adjustment holes communicated with the receiving space, a plurality of adjustment members each moveably mounted in one of the adjustment holes of the mounting plate, and an adjustment plate arranged in the receiving space of the mounting plate, connected with the end of the shaft and stopped by the adjustment members such that a position of the adjustment plate is adjustable relative to the mounting plate by actuations of the adjustment members.

3. The patch fitting of claim 2, wherein the mount further comprises two end plates coupled with two ends of the mounting plate respectively.

4. The patch fitting of claim 2, wherein the mounting plate of the mount is fixedly mounted on the floor by expansion bolts.

5. The patch fitting of claim 1, wherein the clamping seat comprises a seat body provided with the shaft hole and the oil chamber, and two end caps mounted on the seat body to seal two end openings of the oil chamber.

6. The patch fitting of claim 5, wherein the clamping seat further comprises two clamping pieces and a plurality of fasteners; the seat body of the clamping seat comprises an insertion groove in which the glass door is inserted, and a plurality of through holes communicated with the insertion groove; the clamping pieces are arranged in the insertion groove and abutted against two opposite surfaces of the glass door; the fasteners are respectively inserted in the through holes and urged against the clamping pieces such that the clamping pieces firmly clamp the glass door therebetween.

7. The patch fitting of claim 5, wherein the clamping seat further comprises two decorative plates mounted on two opposite side walls of the seat body respectively.

8. The patch fitting of claim 1, further comprising two regulation valves; wherein the oil chamber of the clamping seat includes a compartment communicated with the shaft hole, an oil duct in fluid communication with the compartment, and two valve holes spaced from each other and in fluid communication with the compartment and the oil duct; wherein the piston unit is installed in the compartment and the regulation valves are respectively installed in the valve holes.

9. The patch fitting of claim 1, wherein the piston unit comprises a piston with an elongated through hole through which the shaft passes, a contact member mounted to the piston and contacted with the eccentric cam of the shaft, and at least one spring having two ends stopped at the piston and the clamping seat respectively.

* * * * *